United States Patent [19]

Seaton

[11] 4,155,492

[45] May 22, 1979

[54] STOPPER VALVE FOR A POURING LADLE

[75] Inventor: William W. Seaton, Dexter, Mich.

[73] Assignee: Seaton Engineering, Inc., Ann Arbor, Mich.

[21] Appl. No.: 860,923

[22] Filed: Dec. 15, 1977

[51] Int. Cl.[2] ..... B22D 41/10

[52] U.S. Cl. ..... 222/592; 222/602; 251/319

[58] Field of Search ..... 52/698, 704; 251/319, 251/356, 357, 291, 292; 222/592, 597, 598, 599, 601, 602

[56] References Cited

U.S. PATENT DOCUMENTS

| | | | |
|---|---|---|---|
| 809,177 | 1/1906 | Drolshagen | 52/704 X |
| 1,573,151 | 2/1926 | Fishel | 52/698 X |
| 2,195,791 | 4/1940 | Slick | 222/597 X |
| 3,386,633 | 6/1968 | Nadrich et al. | 222/592 X |
| 3,554,490 | 1/1971 | Cahoon, Jr. | 251/291 X |
| 3,979,031 | 9/1976 | Ericson | 222/592 |

FOREIGN PATENT DOCUMENTS 319586 1/1970 Sweden.

*Primary Examiner*—David A. Scherbel
*Attorney, Agent, or Firm*—Robert L. Olson

[57] ABSTRACT

An air cooled ceramic stopper valve and actuating rod for a bottom pouring ladle. Ceramic parts are assembled onto a metallic stopper rod which contains an enlarged head portion. The metallic stopper rod head is notched, so that refractory cement used to bond the ceramic parts forms a strong mechanical bond between the metal rod and the ceramic point of the valve. The notches provide enough strength in the joint between metal rod to ceramic point to permit shearing loose a frozen stopper valve by rotation (when the valve head [point] bonds to the ceramic orifice).

1 Claim, 3 Drawing Figures

STOPPER VALVE FOR A POURING LADLE

BACKGROUND OF THE INVENTION

One present means of pouring molten metal is by means of a bottom pouring ladle. A ceramic valve having a stiffening metallic stopper rod actuator is positioned within the container and cooperates with the ceramic valve seat in the bottom of the container to control the discharge of molten metal therefrom. On occasion, the ceramic valve becomes frozen on its seat, or does not properly close on the valve seat, necessitating rotation of the valve head with respect to its seat. In the past, such rotation often caused the ceramic valve head to be sheared loose from the metallic stopper rod.

SUMMARY OF THE INVENTION

In accordance with the invention, an air cooled ceramic stopper valve is assembled and cemented onto the end of a metallic stopper rod. The end of the metallic stopper rod contains an enlarged head, which is provided with notches, so that a strong lock or bond exists between the metal and cement. The notches provide enough strength to permit a frozen stopper valve to be freed by rotation, without shearing the bond between the metallic rod and the ceramic valve head.

BRIEF DESCRIPTION OF THE INVENTION

DESCRIPTION OF THE PREFERRED EMBODIMENT

Figure 1:
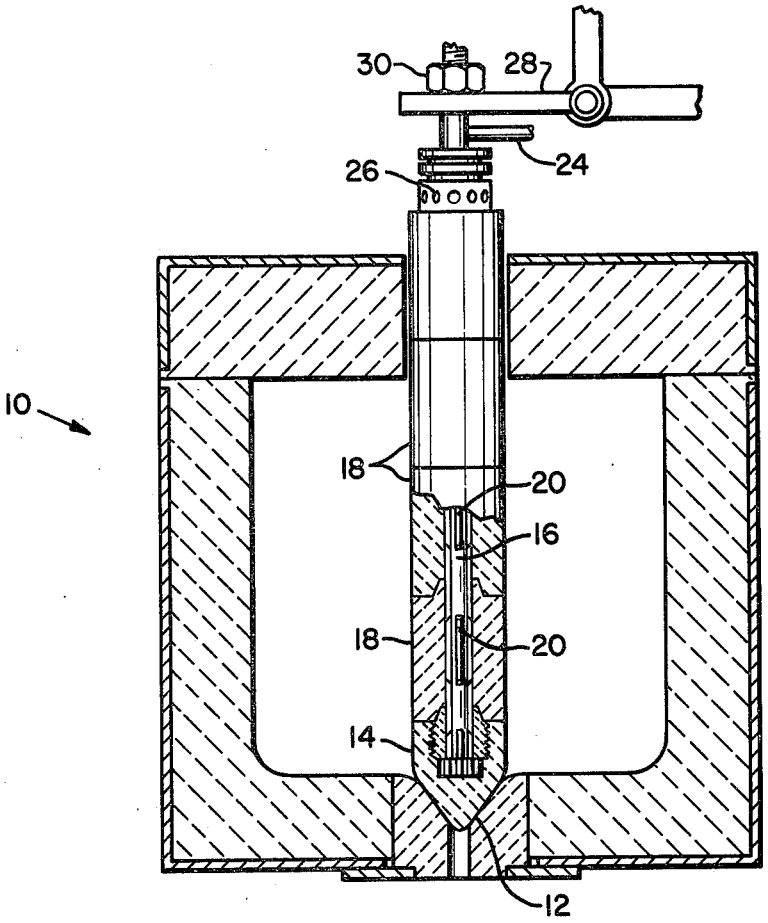
FIG. 1 is a sectional side view of a casting container having a stopper valve and rod constructed in accordance with the invention.

Looking now to FIG. 1, numeral 10 designates a refractory lined casting container, from which molten metal can be poured. The container has a bottom outlet nozzle 12, and a stopper valve 14, for controlling flow of metal from the container. Both of these items are made of special ceramics, which will not only withstand the high temperature, but is erosion resistant also. The stopper valve 14 is mounted on the end of a metallic rod 16. This rod is surrounded by refractory sleeves 18 to protect it from the molten metal within container 10. The metal rod has fins 20, which keep the rod in place within the refractory sleeves 18. The manner in which the metal rod is secured to the valve will be described in detail below. The space between the metal rod 16 and sleeves 18 is air cooled, air being introduced through inlet 24, and withdrawn through the outlets 26. The valve is actuated in any suitable manner, for example by lever 28.

On occasion, the stopper valve 14 will become frozen on its seat 12. A nut 30 is locked onto the rod 16 above the container, and the valve can be freed by applying a wrench to this nut and turning.

Figure 3:
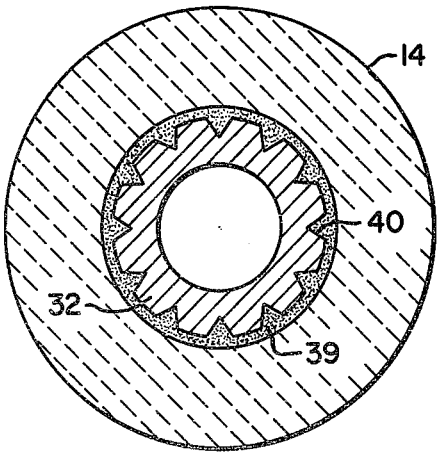
FIG. 3 is a view taken on line 3—3 of FIG. 2.
Figure 2:
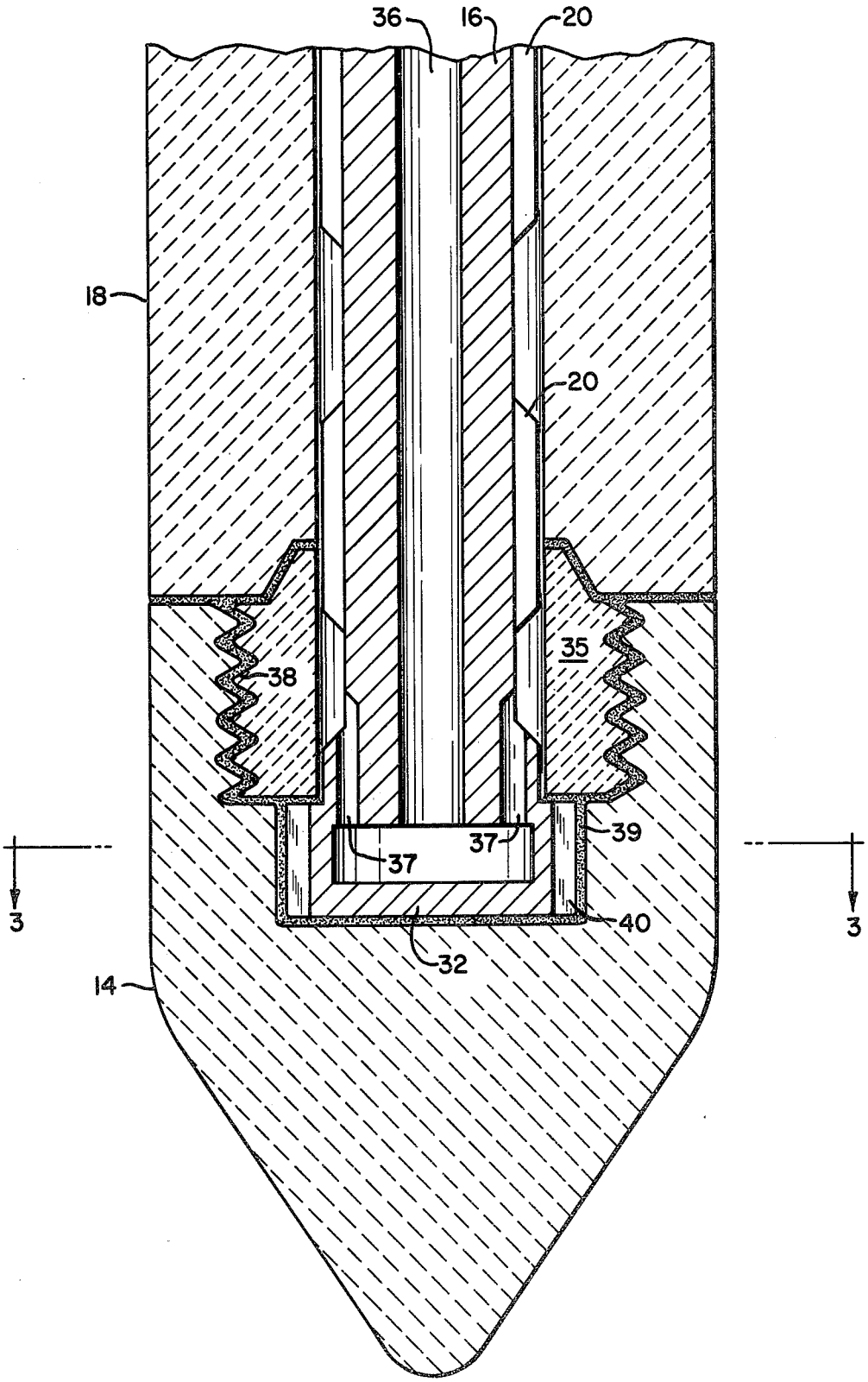
FIG. 2 is an enlarged sectional view of the stopper valve and rod shown in FIG. 1.

Looking now to FIGS. 2 and 3, the connection between the metal stopper rod 16 and the ceramic stopper valve head 14 is shown in detail. The metallic rod 16 has an enlarged head or end 32. The rod is hollow, having a central air cooling passage 36. A plurality of holes 37 in the upper portion of the enlarged end also form part of the air cooling passage. Holding the valve head 14 on the enlarged end 32 of the metal rod 16 is a ceramic bushing or collar 35, which has male threads 38 for threading into the threaded opening in valve head 14.

At the time these parts are assembled, a heavy coating of refractory cement 39 is initially poured into the space between the enlarged head 32 of the metal rod and the ceramic valve head 14 to fill this space or void. The outer threads of collar 35 are also coated with refractory cement before being slipped over the upper end of rod 16, and threaded into valve head 14. As shown in FIGS. 2 and 3, the enlarged end 32 of the metal rod has a series of vertical notches 40 around its entire periphery, which notches are completely filled with refractory cement during assembly. This forms a strong bond between the metal head 32 and the ceramic valve 14 which prevents them from being broken loose when it becomes necessary to rotate the valve 14. If the outer surface of metal head 32 were smooth there would be a much greater risk of shearing this connection during rotation of the rod 16. The adherence between the ceramic of valve 14 and the refractory cement 39 is such that notching of the ceramic head is not necessary.

What is claimed is:

1. Apparatus for controlling the discharge of molten metal through a bottom opening of a casting container comprising a ceramic valve head, a metallic stopper rod for actuating the valve head, said metallic stopper rod having an enlarged end portion extending into and being cemented to the valve head, the outer surface of the enlarged end portion of the metallic stopper rod containing a plurality of vertically extending notches so a good bond exists between the rod and valve head, refractory sleeve means surrounding and slightly spaced from the metallic stopper rod, and means for introducing air into the space therebetween.

* * * * *